US012163754B2

(12) United States Patent
Schrödl et al.

(10) Patent No.: US 12,163,754 B2
(45) Date of Patent: Dec. 10, 2024

(54) GAS SYSTEM OF A FIREARM

(71) Applicant: SAKO OY, Riihimäki (FI)

(72) Inventors: Christoph Schrödl, Porvoo (FI); Hannu Törmänen, Hämeenlinna (FI)

(73) Assignee: SAKO OY, Riihimaki (FI)

( * ) Notice: Subject to any disclaimer, the term of this patent is extended or adjusted under 35 U.S.C. 154(b) by 106 days.

(21) Appl. No.: 17/922,961

(22) PCT Filed: May 20, 2021

(86) PCT No.: PCT/EP2021/063474
§ 371 (c)(1),
(2) Date: Nov. 2, 2022

(87) PCT Pub. No.: WO2021/234090
PCT Pub. Date: Nov. 25, 2021

(65) Prior Publication Data

US 2023/0160648 A1 May 25, 2023

(30) Foreign Application Priority Data

May 20, 2020 (FI) ..... 20205509

(51) Int. Cl.
*F41A 5/18* (2006.01)
*F41A 5/20* (2006.01)

(52) U.S. Cl.
CPC . *F41A 5/20* (2013.01); *F41A 5/18* (2013.01)

(58) Field of Classification Search
CPC ..... F41A 5/18; F41A 5/20; F41A 5/22; F41A 5/26; F41A 5/28; F41A 89/193
See application file for complete search history.

(56) References Cited

U.S. PATENT DOCUMENTS 2,409,225 A * 10/1946 Schaich ..... F41A 5/26 89/193
2,482,880 A * 9/1949 Sefried ..... F41A 5/18 89/193

(Continued)

FOREIGN PATENT DOCUMENTS

EP 0634620 A1 1/1995
EP 3164661 A1 5/2017
FR 1286037 * 1/1967

OTHER PUBLICATIONS

International Search Report and Written Opinion in Application No. PCT/EP2021/063474, mailed Sep. 10, 2021, 14 pages.

(Continued)

*Primary Examiner* — Joshua E Freeman
(74) *Attorney, Agent, or Firm* — Meunier Carlin & Curfman LLC

(57) ABSTRACT

The invention relates to a firearm comprising a barrel comprising a gas opening, and a gas system, which gas system comprises a gas block, a gas piston, a force transmitter assembly, an indexing part and an indexing counterpart, gas openings. The gas block is fixedly attached to the barrel and the gas piston is positioned by the indexing part. In the gas system gas is configured to pass through the gas opening of the barrel via the gas openings of the gas system into the gas block and to set the gas piston to movement. In the gas system the gas piston during its movement backwards is configured to close the gas opening of the barrel for a defined time period and the gas piston is not transmitting power/energy from combustion gas to the force transmitter assembly unless the gas opening/-s is/are closed.

11 Claims, 14 Drawing Sheets

(56) References Cited

U.S. PATENT DOCUMENTS

| | | | | |
|---|---|---|---|---|
| 2,714,334 | A * | 8/1955 | Harvey | F41A 19/46 89/190 |
| 4,475,438 | A * | 10/1984 | Sullivan | F41A 3/82 89/185 |
| 4,702,146 | A | 10/1987 | Ikeda et al. | |
| 6,508,160 | B2 * | 1/2003 | Beretta | F41A 5/26 89/193 |
| 8,161,864 | B1 * | 4/2012 | Vuksanovich | F41A 5/26 89/193 |
| 8,176,837 | B1 | 5/2012 | Jackson | |
| 8,640,598 | B1 * | 2/2014 | Jackson | F41A 5/20 89/191.01 |
| 9,261,314 | B1 * | 2/2016 | Jackson | F41A 5/26 |
| 9,500,422 | B2 * | 11/2016 | Gomirato | F41A 5/20 |
| 9,702,644 | B2 * | 7/2017 | Daley, Jr. | F41A 5/26 |
| 10,222,151 | B2 | 3/2019 | Daley, Jr. et al. | |
| 2008/0276797 | A1 * | 11/2008 | Leitner-Wise | F41A 5/18 89/191.01 |
| 2009/0223357 | A1 * | 9/2009 | Herring | F41A 5/18 89/193 |
| 2010/0251885 | A1 | 10/2010 | Stone | |
| 2014/0083286 | A1 * | 3/2014 | Gomez | F41A 5/18 89/193 |
| 2014/0182450 | A1 * | 7/2014 | Boutin, Jr. | F41A 5/18 89/193 |
| 2016/0178299 | A1 * | 6/2016 | Cassels | F41A 5/28 89/193 |
| 2019/0226776 | A1 * | 7/2019 | DiChario | F41A 3/26 |
| 2020/0116446 | A1 * | 4/2020 | Lynch | F41A 5/28 |
| 2020/0318920 | A1 * | 10/2020 | Lynch | F41A 5/28 |
| 2020/0378702 | A1 * | 12/2020 | DiChario | F41A 5/20 |
| 2021/0404755 | A1 * | 12/2021 | Mirzoev | F41A 5/18 |
| 2022/0146221 | A1 * | 5/2022 | Razpet | F41A 5/20 |

OTHER PUBLICATIONS

Finnish Search Report in Finnish U.S. Appl. No. 20/205,509, dated Dec. 3, 2020, 2 pages.

"U.S. Rifle, Caliber 7.62MM, M14—Operation and Cycle of Functioning", Youtube [online] [video], uploaded Aug. 8, 2010, retrieved on Nov. 27, 2020, <https://www.youtube.com/watch?v=1Kgnh4neVaY>, time frame 16:00-18:30; screenshots—document made by the examiner on Nov. 27, 2020 the video and the document made by the examiner.

* cited by examiner

GAS SYSTEM OF A FIREARM

CROSS REFERENCE TO RELATED APPLICATIONS

This application is a United States National Phase Patent Application of International Patent Application Number PCT/EP2021/063474, filed on May 20, 2021, which claims the benefit of priority to FI application Ser. No. 20/205,509, filed May 20, 2020.

TECHNICAL FIELD

The present invention relates generally to firearms, in particular to gas systems for firearms, especially for automatic and semi-automatic firearms. More precisely the present invention relates to a gas system of a firearm according to the preamble part of claim 1.

BACKGROUND

In firearms, usually in semi-automatic or automatic firearms, a gas system is used for the autoloading cycle for loading the cartridge and removing the shells. In the gas system of the firearm, part of pressurized gas from the cartridge being fired is used to power the gas system to extract the spent case and chamber a new cartridge. Energy from the gas is transmitted through gas openings in the barrel of the firearm. This high-pressure gas impinges on a surface such as a piston head to provide motion for unlocking of the action, extraction of the spent case, ejection, cocking of the hammer and loading of a fresh cartridge. A short stroke gas piston operating system is common on modern rifles. It is defined as a gas piston which travels less than the distance of the bolt carrier. The present invention relates to gas systems operating based on the short stroke gas piston.

The gas systems of firearms known from prior art known as fixed gas systems take gas all the time from the barrel as long as there is pressure, which may lead to variations in acceleration to the bolt carrier assembly, which typically causes functional issues (reliability, cycling, feeding, extraction etc.), dependent on loading and type of used cartridge (bullet, powder etc.). In prior art gas system this is usually overcome by using a manually adjustable gas regulator. Disadvantage of the regulator being manual, is that the user can forget to use the regulator for example in stressing situations, which naturally may have technical and/or functional consequences. Especially difficult situation may be caused, when a suppressor is used as then a back-pressure phenomena might be caused and in worst case the firearm malfunctions and/or breaks down. Thus, in these types of firearms typically only one or a few types of ammunition is used.

In patent publication U.S. Ser. No. 10/222,151 B2 is disclosed an autoloader for a gas operated automated firearm, comprising a gas chamber including an inner diameter and constructed and arranged to receive pressurized combustion gas from a gas port of a barrel of the firearm when a round is fired from the firearm; a piston having a piston head in fluid communication with said gas chamber, said piston constructed and arranged to move away from a firing position to actuate at least a portion of a cycle of the firearm when urged by pressurized combustion gas received in said gas chamber and an expansion valve disposed within the gas chamber, the expansion valve constructed and arranged to move along the inner diameter of the gas chamber from a firing position to increase a volume of said gas chamber when pressure in the gas chamber exceeds a threshold level.

In patent publication U.S. Pat. No. 9,702,644 B2 is disclosed a regulator for a gas operated firearm auto loader, comprising a chamber constructed and arranged to receive pressurized combustion gas from a gas port of a barrel of the firearm when a round is fired from the firearm, a piston having a piston head in fluid communication with said chamber, the piston constructed and arranged to move away from a firing position to actuate at least a portion of a cycle of the firearm when urged by pressurized combustion gas received in said chamber, and a throttling valve in fluid communication with said chamber, the throttling valve having a first position in which pressurized combustion gas from the gas port of a barrel of a firearm can flow into the chamber, and a second position in which pressurized combustion gas from the gas port of a barrel of a firearm cannot flow into the chamber, and wherein the throttling valve is configured to move from the first position to the second position when pressure in the chamber exceeds a threshold level.

An object of the present invention is to create a gas system of a firearm by which the above described problems and disadvantages of gas systems known from prior art are eliminated or at least minimized.

Another object of the present invention is to create an improved gas system of a firearm, in which human error caused disadvantages are minimized.

Another object of the present invention is to provide an improved gas system of a firearm, which is not ammunition sensitive.

Yet, another object of the present invention is to provide an improved gas system, in which manual gas adjustment is not needed.

SUMMARY

In order to achieve the above objects and those that will come apparent later the gas system of a firearm is mainly characterized by the features of the characterizing part of claim 1.

Dependent claims present advantageous features and embodiments of the invention.

According to the invention the firearm comprises a barrel comprising gas openings, and a gas system, which gas system comprises a gas block, a gas piston, a force transmitter assembly, an indexing part and an indexing counterpart, gas openings, wherein the gas block is fixedly attached to the barrel, the gas piston is positioned by the indexing part, in the gas system gas is configured to pass through the gas opening of the barrel via the gas openings of the gas system into the gas block and to set the gas piston to movement and that in the gas system the gas piston during its movement backwards is configured to close the gas opening of the barrel for a defined time period and the gas piston is not transmitting power/energy from combustion gas to the force transmitter assembly unless the gas openings are closed. Thus, the gas system is connected to the gas of the barrel only during the defined time and the gas system is automatically controlled to prevent unlimited amount of gas entering from the barrel to the gas block. First the gas piston moves back, at the same time shutting the gas openings and finally making contact and transmitting energy/forces to the bolt carrier via the force transmitter assembly.

According to an advantageous feature of the invention the gas system is a short stroke gas piston system.

According to an advantageous feature of the invention the gas block is attached onto the barrel of the firearm.

According to an advantageous feature of the invention the gas block is attached around the barrel of the firearm.

According to an advantageous feature of the invention the gas system comprises an exhaust opening in the gas block and after a certain period of time the exhaust opening connected to ambient pressure is opened.

According to an advantageous feature of the invention the gas block and the gas piston together form a hollow encapsulation which is filled with gas from barrel.

According to the invention the gas piston is connected via a spring-loaded pin or bushing to at least one force transmitter of the force transmitter assembly.

According to an advantageous feature of the invention the force transmitter assembly comprises a helical return spring, which is configured to function as a return-spring returning the force transmitter assembly and the gas piston to its initial position.

According to an advantageous feature of the invention the indexing part comprises beveled surfaces and an indexing groove to keep the gas openings of the gas piston aligned with gas openings in the barrel and the gas block.

According to an advantageous feature of the invention the indexing part has an indexing counterpart with an indexing protrusion, which corresponds to the indexing groove of the indexing part of the gas piston.

According to an advantageous feature of the invention the gas system is located around the barrel of the firearm and comprises the gas block, the gas piston by which the energy of the gas is transmitted to mechanical movement inside the gas block, the indexing part and the force transmitter assembly and that the force transmitter assembly comprises a force transmitter sleeve, an extension part with a spring, spring-loaded pins with springs and a guide pin for keeping the gas openings in gas piston and barrel aligned.

According to an advantageous feature of the invention outer surface of the gas piston is provided with grooves for crust removal.

In this description the terms, back, front, upper, lower etc. are used as reference to the normal position of a firearm, when used for firing. They are not to have any as such limiting effect.

According to the invention in the autoloading cycle, the gas space within the gas block is filled for a determined time, the gas system is configured to close the gas connection between the gas openings of the gas system and the gas opening of the barrel and thus, only a certain, selected amount of gas is let into the gas space within the gas block to create the pressure behind the gas piston.

By the gas system according to the invention and its advantageous features many advantages are achieved: The gas system of the firearm according to the invention has an automatic function principle and thus, there is no need of human input and any disadvantages caused by human error are minimized. The gas system of the firearm according to the invention has a self-regulating function principle and thus, no manual gas adjustment is necessary. In the gas system of the firearm according to the invention the gas system shuts gas opening in the gas block once a specific amount of gas is taken for cycling the firearm. The user can safely operate the firearm with both a suppressor and without a suppressor. Further, the firearm is not ammunition sensitive as the gas system functions well with different kinds of loads. The risk of overloading the firearm system is eliminated and hence long-lifetime for the components (extractor, buffer etc.) is achieved.

BRIEF DESCRIPTION OF THE DRAWINGS

In the following the invention and its advantages are explained in greater detail below in the sense of example and with reference to accompanying drawing, where In FIG. 1 is schematically shown an advantageous example of a firearm.

DETAILED DESCRIPTION

During the course of the following description like numbers and signs will be used to identify like elements according to the different views which illustrate the invention and its advantageous examples. In the figures some repetitive reference signs may have been omitted for clarity reasons.

Figure 1:
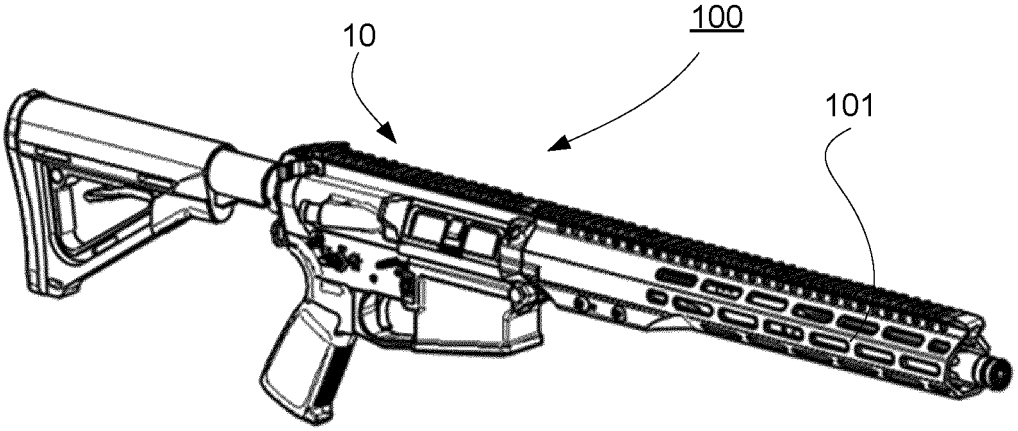

In the FIG. 1 is shown an example of a firearm 100 comprising a barrel 101 and gas system 10. The gas system 10 operates based on the short stroke gas piston system.

In FIGS. 2-24 is shown one advantageous embodiment of the gas system according to the invention.

Figure 2:
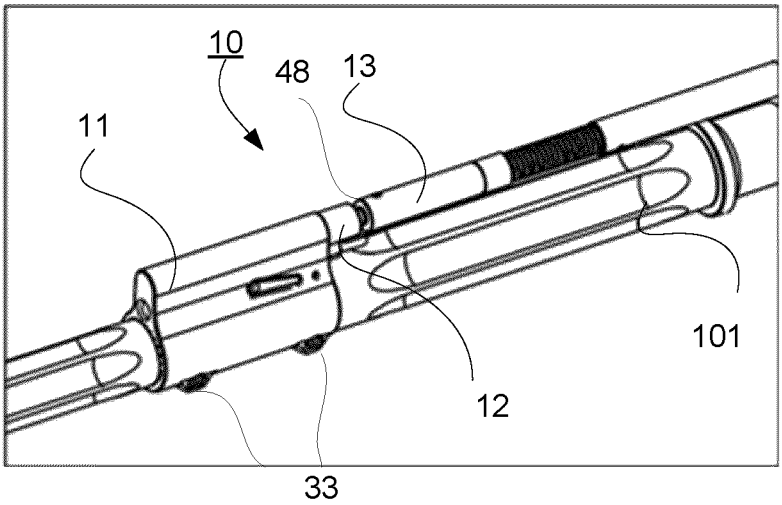
In FIGS. 2-21 is schematically shown an advantageous example of a gas system according to the invention with variations of details of the example, in which the gas system is arranged on top of the barrel of the firearm.

In the example of FIG. 2 is shown an example of the gas system 10 of the firearm 100. The gas system 10 comprises a gas block 11, which is attached to a barrel 101 of the firearm 100 by spiral pins 33, a gas piston 12 by which energy of the gas from barrel 101 is transmitted to mechanical movement, and a force transmitter assembly 13. The gas block 11 and the gas piston 12 together form a hollow encapsulation which is filled with gas from barrel 101. The gas piston 12 is connected via a spring-loaded pin 14 (FIG. 3) to a force transmitter 15 (FIG. 3) of the force transmitter assembly 13. The spring 47 providing the spring-loading of the spring-loaded pin 14 is denoted by reference 47 in FIG. 3. The spring-loaded pin 14 is first compressed before contact is made to the force transmitter 15 of the force transmitter assembly. Once contact is made i.e. the gap 48 between the gas piston 12 and the force transmitter assembly 13 is closed, gas forces transmit to bolt carrier (not shown and cycling process of autoloading starts. Before that no acceleration happens to the bolt carrier assembly and a bolt (not shown) of the bolt carrier stays closed. At this position, the autoloading cycle begins.

Figure 3:
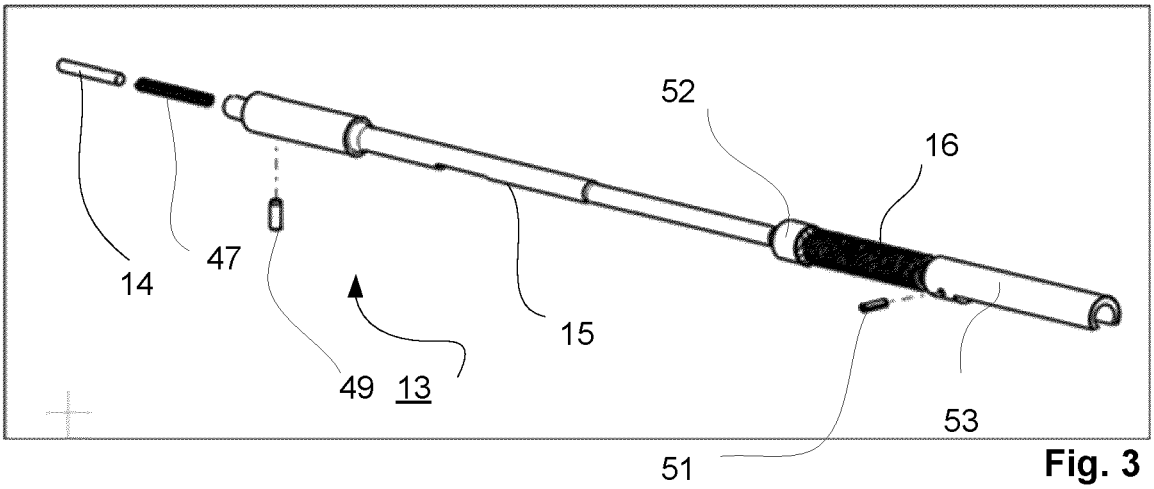

In FIG. 3 is shown an alternative of an assembly of the force transmitter assembly 13 comprising a force transmitter 15 as an exploded view. The force transmitter assembly 13 comprises by the spring 47 spring-loaded pin 14 at one end of the force transmitter 15 of the force transmitter assembly 13. The force transmitter assembly 13 also comprises a cotter pin 49 and a spring pin 51 for fastening the components of the force transmitter assembly as shown in the FIG. 3. Further, the force transmitter assembly 13 comprises a helical, return spring 16, which functions as a return-spring returning the force transmitter assembly 13 back into its initial position independent of bolt carrier movement. The helical, return spring 16 is located making contact with a spring bushing 52. The force transmitter assembly 13 also comprises a bushing 53 for guiding the force transmitter 15.

Figure 4:
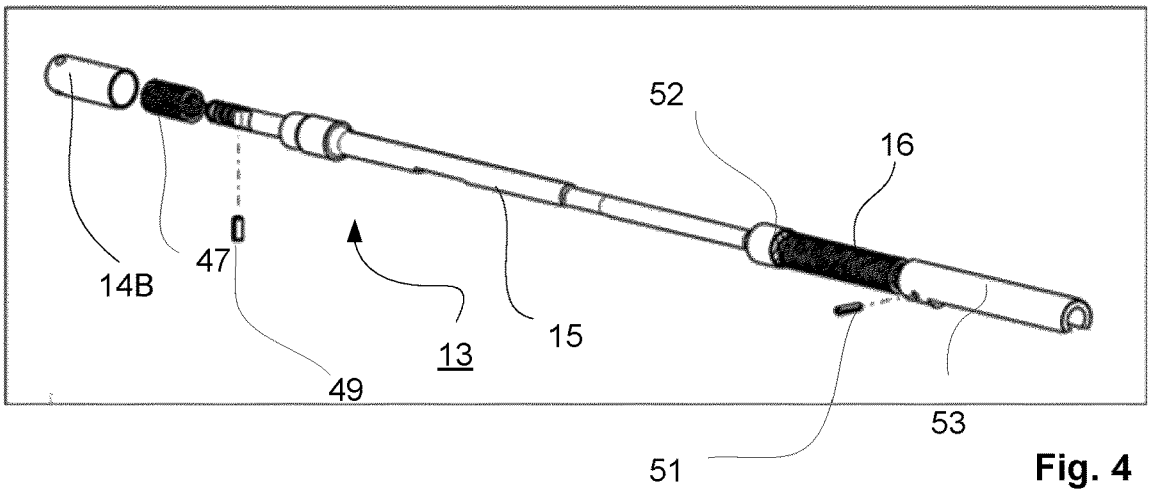

In FIG. 4 is shown another alternative of an assembly of the force transmitter assembly 13 but instead the spring 47 loading the spring-loaded pin 14 (FIG. 3) at one end of the force transmitter 15 of the force transmitter assembly 13 the spring 47 effects the spring-load to a bushing 14B.

Figure 5:
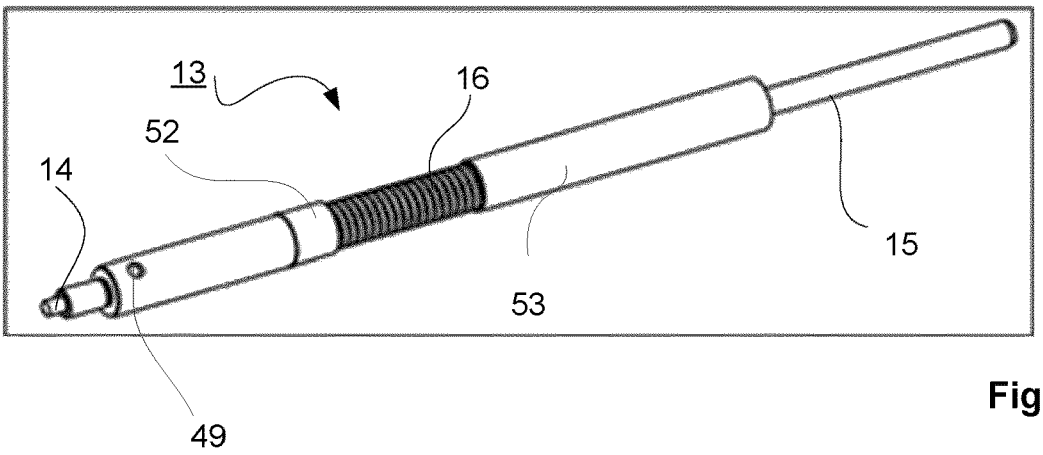

In FIG. 5 is shown the force transmitter assembly 13 in accordance with the example of FIG. 3 as an assembled view. At one end of the force transmitter 15 of the force transmitter assembly 13 is the spring-loaded pin 14, which controls movements of the gas piston 12.

Figure 6:
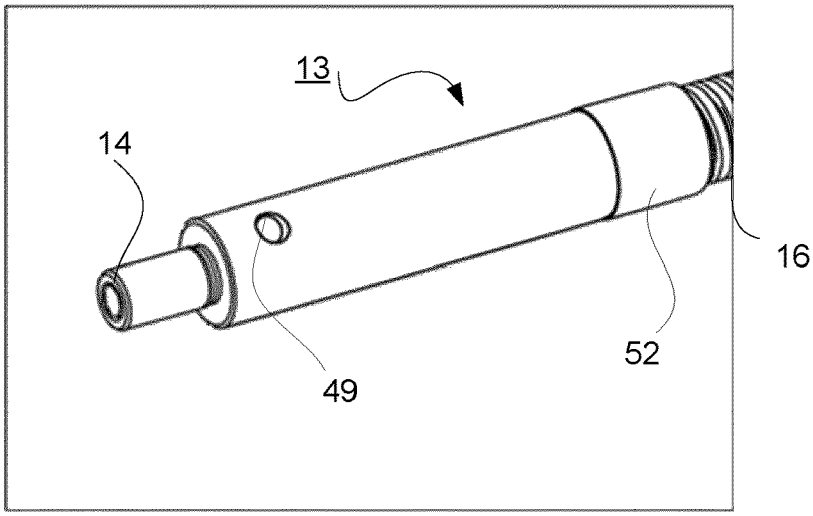

In FIG. 6 is shown in more detail the spring-loaded pin 14 of the force transmitter assembly 13 in accordance with the example of FIG. 3. The spring-loaded pin 14, which controls movements of the gas piston 12, is pressed in, when the gas piston 12 makes contact to the force transmitter 15.

Figure 7:
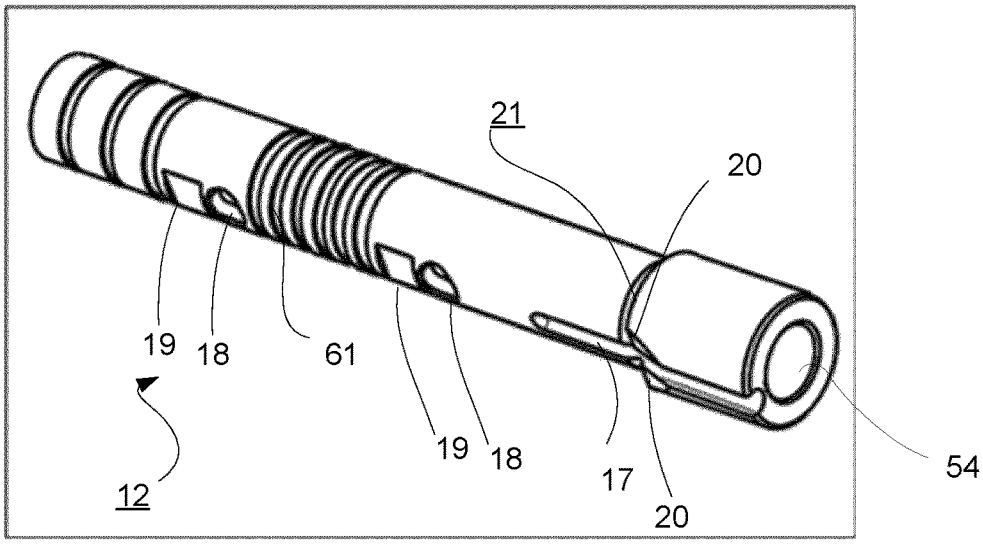

In FIG. 7 is shown in more detail the gas piston 12 in accordance with the example of FIG. 2. Gas openings 18 are located on the gas piston 12. Next to the gas openings 18 are located planar surface parts 19 for cleaner operation. Outer surface of the gas piston 12 is also provided with grooves 61 for crust removal. The gas piston 12 is provided with an indexing part 21 with bevelled surfaces 20 and an indexing groove 17 to keep the gas openings 18 of the gas piston 12 aligned with gas openings in the barrel 101 and the gas block 11. If this would be in wrong position, no gas could flow into the gas piston 12. The indexing groove 17 is to secure the gas piston 12 at correct position inside the gas block 11, which moves the gas piston 12 that actuates the force transmitter 15 included in the force transmitter assembly 13, which at the end pushes a bolt carrier. The force transmitter 15 is mounted to an opening 54 at one end of the gas piston 12.

Figure 8:
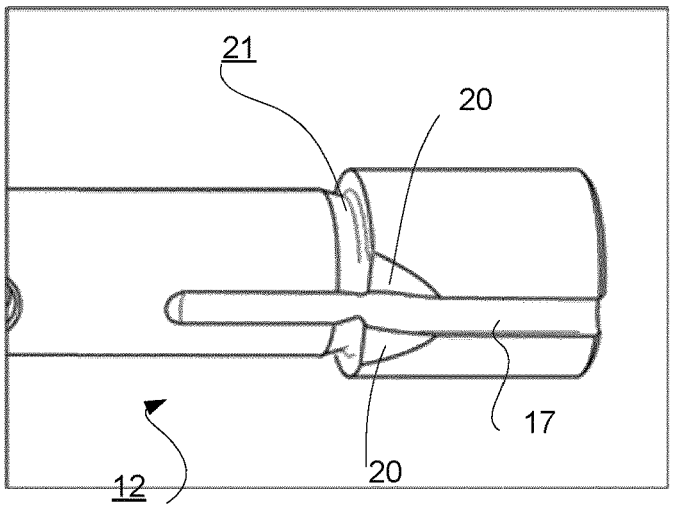

In FIG. 8 is shown in more detail one end of the gas piston 12 in accordance with the example of FIG. 7. The indexing groove 17 for securing the gas piston 12 has the beveled surface parts 20.

Figure 9:
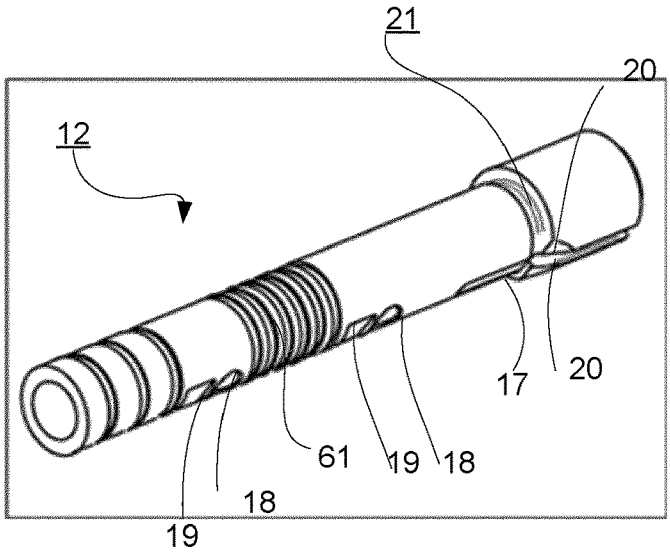

In FIG. 9 is shown in more detail front side of the gas piston 12 in accordance with the example of FIG. 7. As can be seen from the figure the gas piston 12 has a tubular form.

Figure 10:
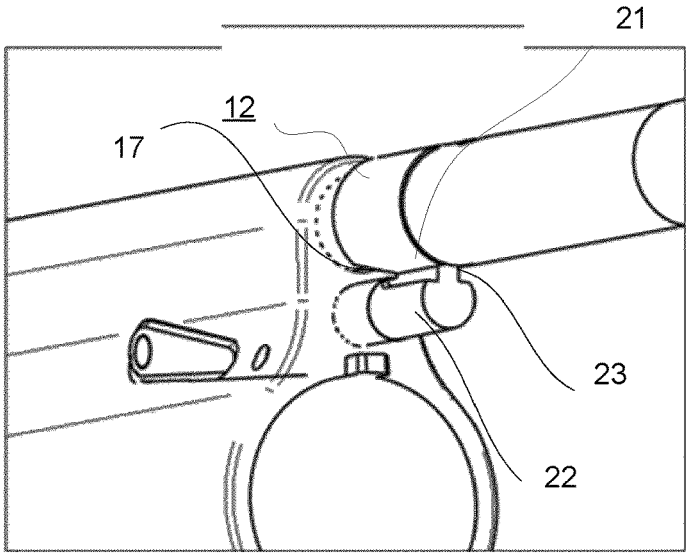

In FIG. 10 is shown in more detail front side of an indexing counterpart 22 located below the gas piston 12 in accordance with the example of FIG. 2. The indexing part 21 comprises thus the indexing counterpart 22. The indexing counterpart 22 has an indexing protrusion 23, which corresponds to the indexing groove 17 of the indexing part 21 of the gas piston 12. A form-fitting joint is formed by the indexing groove 17 of the indexing part 21 and the indexing protrusion 23 of the indexing counterpart 22 and thus, the gas piston 12 is located at the correct position. The indexing protrusion 23 guides by the indexing groove 17 the gas piston 12 to its correct location.

Figure 11:
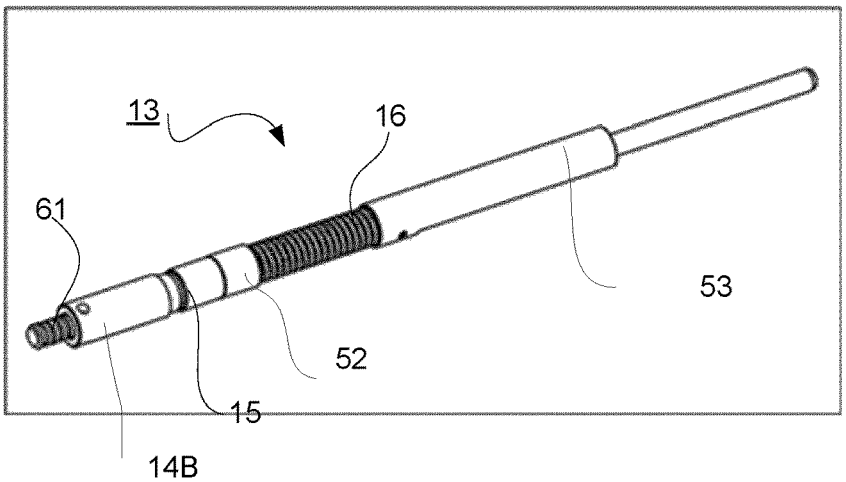

In FIG. 11 is shown the force transmitter assembly 13 in accordance with the example of FIG. 4 as an assembled view. In this example the force transmitter assembly 13 comprises by the spring 47 (FIG. 4) spring-loaded bushing 14B at one end of the force transmitter 15 of the force transmitter assembly 13. The spring 47 effects the spring-load to the bushing 14B. Further, the force transmitter assembly 13 comprises the helical, return spring 16, which functions as the return-spring returning the force transmitter assembly 13, when the bolt carrier has returned back. The helical, return spring 16 is located at a spring bushing 52. The force transmitter assembly 13 also comprises a bushing 53 for guiding the force transmitter 15.

Figure 12:
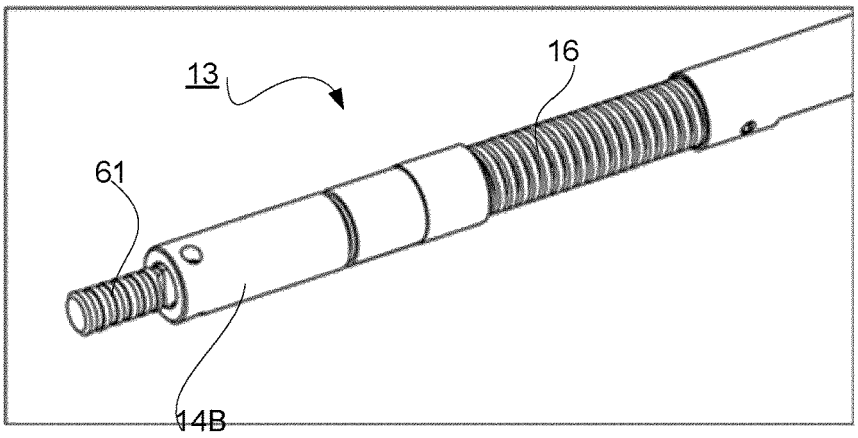

In the FIG. 12 is shown a more detailed example of the outer circumference with crust removal grooves 61 of the force transmitter 15 of the force transmitter assembly 13 in accordance with the example of FIG. 4. The spring-loaded bushing 14B does the same function as the spring-loaded pin 14. The spring 47 is located inside bushing 14B and is a helical spring and the forces are transmitted using the helical spring 47 inside to the force transmitter 15.

Figure 13:
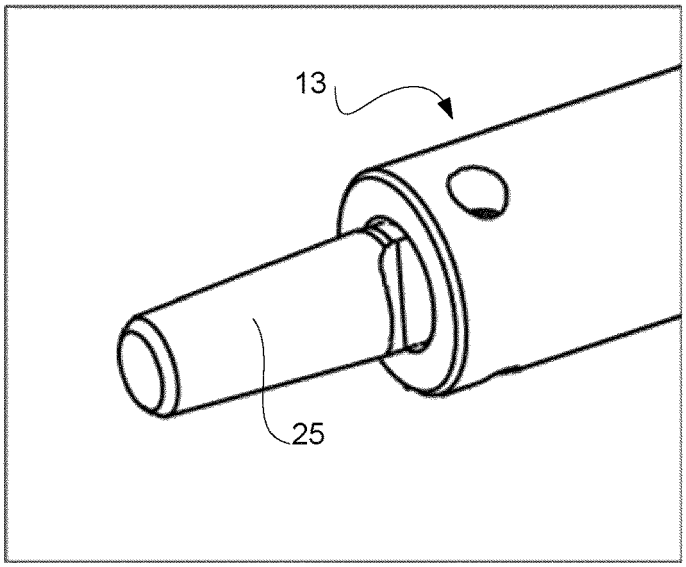

In the FIG. 13 is shown a more detailed example of an example of an end 25 of the force transmitter assembly 13 in accordance with the example of FIG. 4. In this example the end 25 of the force transmitter assembly 13 is tapered for controlling the position of the force transmitter assembly 13 in conjunction with a gas piston 12 (FIG. 16).

Figure 14:
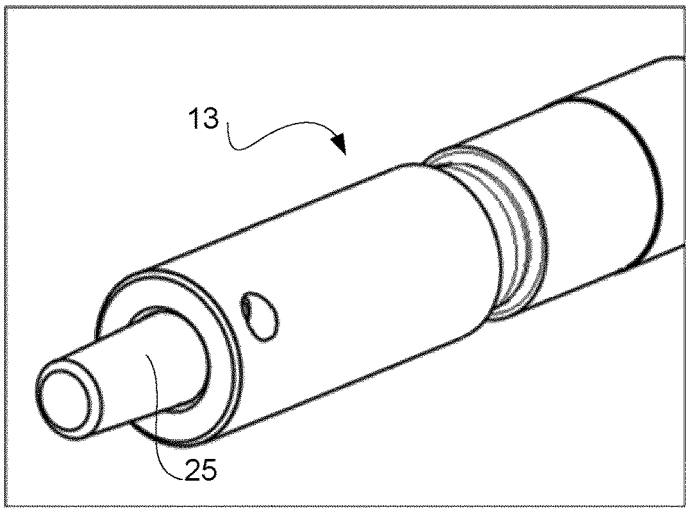
Figure 15:
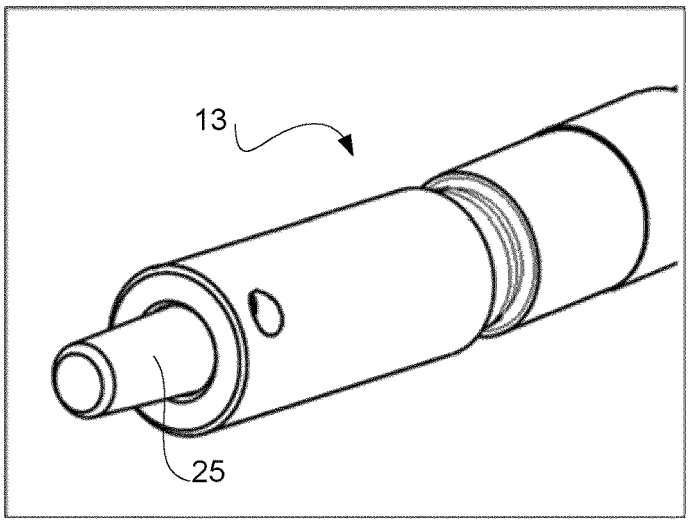

In the FIGS. 14 and 15 are shown more detailed examples of further examples for controlling the position of the force transmitter assembly 13 by the end 25 of the force transmitter assembly 13 in accordance with the example of FIG. 4. In these examples one end 25 of the force transmitter 15 is turnable to selected positions.

Figure 16:
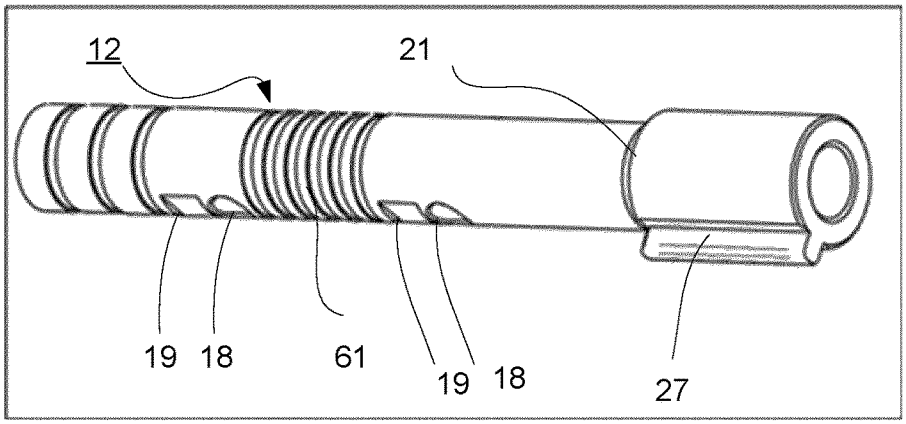
Figure 17:
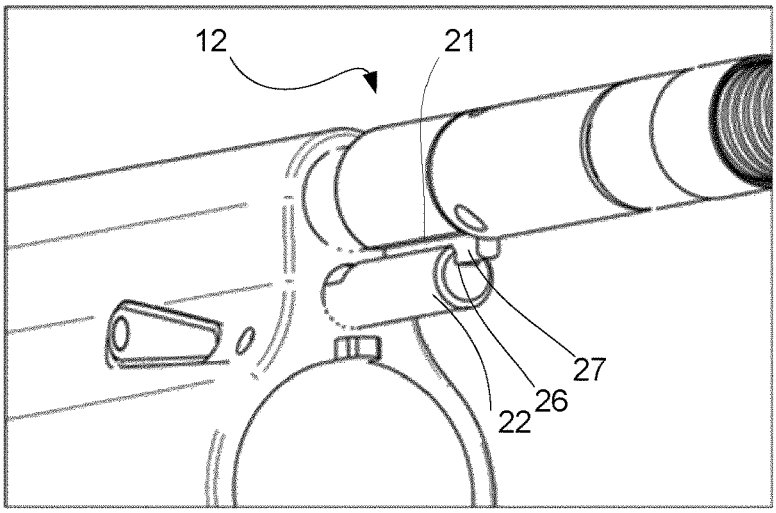

In FIG. 16 is shown a more detailed example of an alternative of the indexing part 21 of the gas piston 12. The indexing part 21 of the gas piston 12 has a protrusion 27, which corresponds to the indexing groove 27 of the indexing counterpart 22 (FIG. 17). A form-fitting joint is formed by the indexing groove 26 and the indexing protrusion 27 and thus, the gas piston 12 is located at the correct position. The indexing protrusion 27 guides by the indexing groove 26 the gas piston 12 to its correct location.

In FIG. 17 is shown the example of FIG. 16 yet in greater detail. Additionally, in the figure is shown the gas piston 12 at the position, where it has travelled to contact the force transmitter 15. In this position no more gas passes from the barrel 101 of the firearm 100 to the gas piston 12 and charging is finished. Only the gas encapsulated inside the gas block/gas piston 12 volume is contributing to the cycling of the weapon now.

Figure 18:
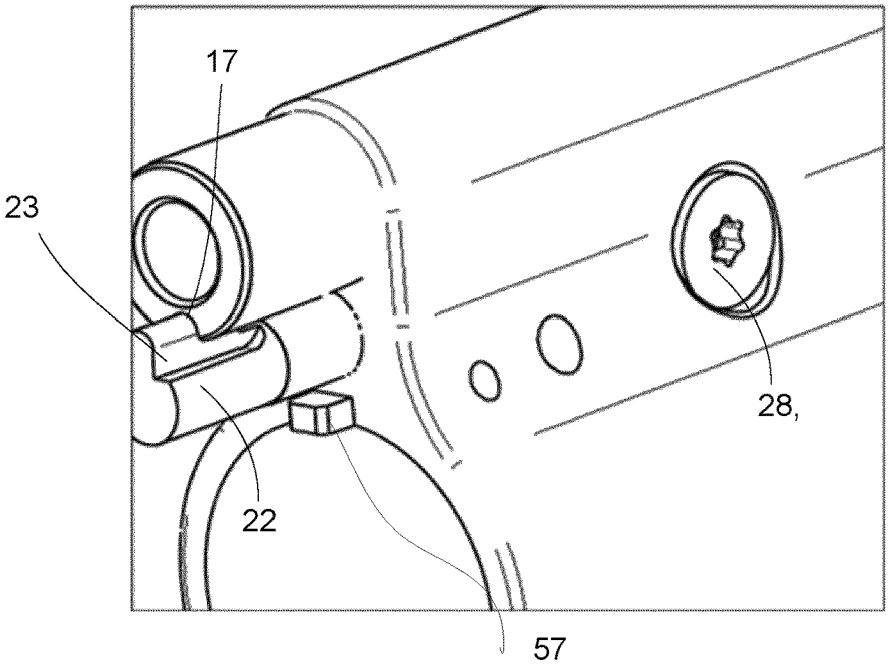
Figure 19:
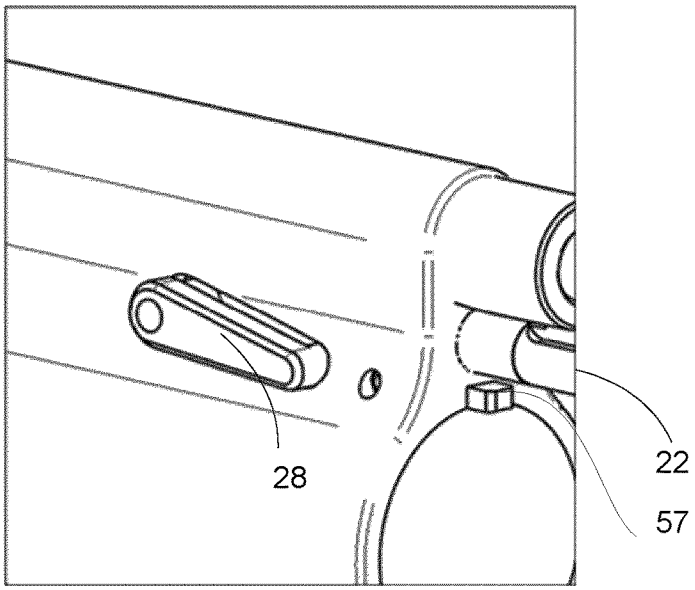

In FIGS. 18 and 19 is shown the example of FIG. 10. The press button assembly 28 is pressed down and the indexing counterpart 22 is unlocked and the gas piston 12 is released as shown in FIGS. 7-9. The positioning tag 57 positions the barrel 101 and the gas block 11.

Figure 20:
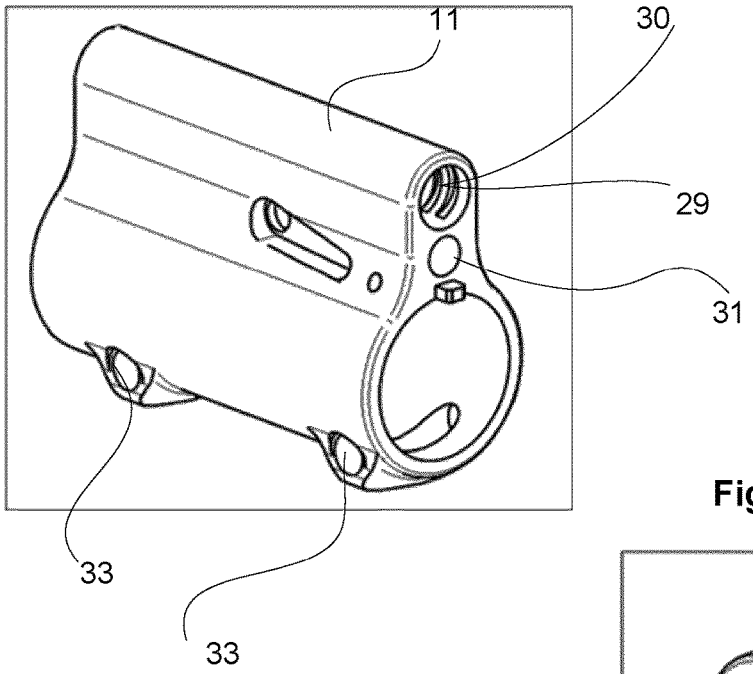
Figure 21:
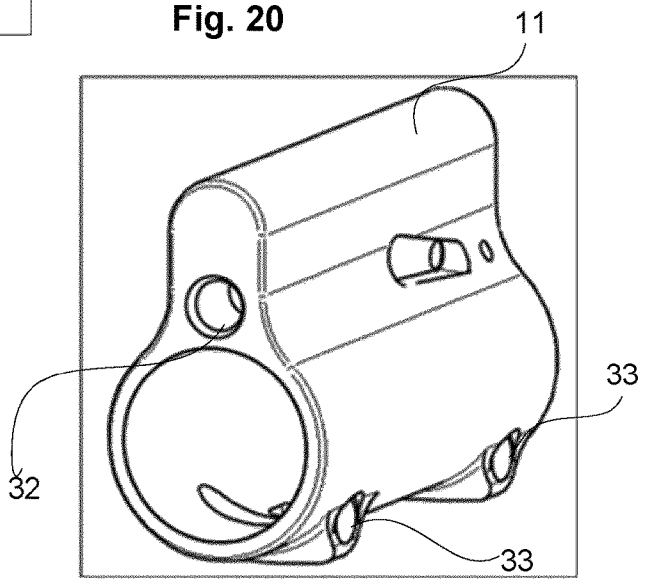

In FIGS. 20-21 is shown the gas block 11 of the gas system 10. Inside the gas block 11 a space 29 is provided for the gas piston 12. Towards the space 29 inside the gas block 11 grooving 30 is provided for crust removal and gas sealing. At least one bore 31 is provided also in the gas block 11 for the indexing counterpart 22. Additionally, one exhaust opening 32 is provided on the front of the gas block 11. The gas block 11 will be attached onto the barrel 101 of the firearm 100 by attachment means, for example by spiral locking pins 33.

In the following the operation of the gas system 10 is described with reference to FIGS. 22-24 and to the example of the FIGS. 2-21.

Figure 22:
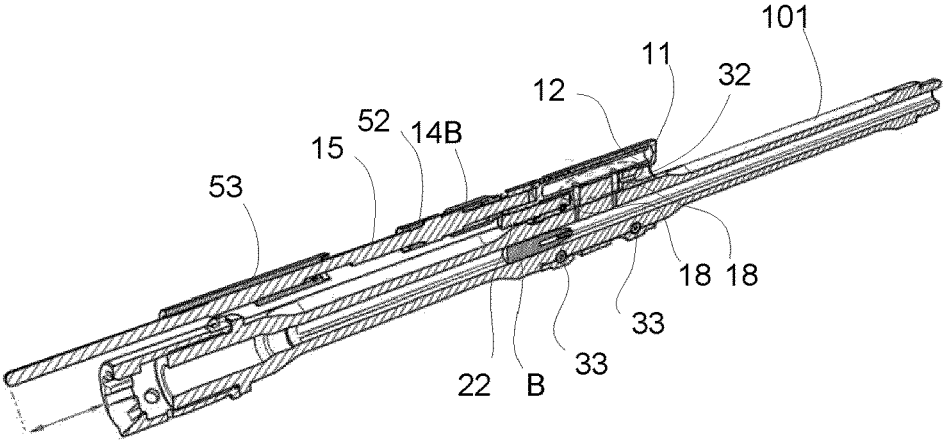
In FIGS. 22-24 is schematically shown advantageous examples of operation of the gas system according to the invention.

In FIG. 22 is shown stage 1, when a shot is fired and the bullet B has not yet reached the gas openings 18 and no gas passes yet into the gas block 11. In this stage openings of the gas piston 12 are aligned with the gas openings 18 and the exhaust opening 32 is closed by the gas piston 12. Thus, the gas system 10 is still in its initial setting. Once the bullet B passes beyond the first of the gas openings 18, gas will start streaming into the gas block 11. The pressure inside the gas block 11 rises and the gas piston 12 starts moving, while the bullet B continues its travelling towards the end of the barrel 101. The gas piston 12 acts on the bushing 14B or the spring loaded pin 14 respectively (FIGS. 4-6) integrated into the force transmitter assembly 13 (FIGS. 2-7, 11-15) and the force transmitter 15 (FIGS. 2-7, 11-12, 17), which do not move at this point and hence do not transmit momentum onto the bolt carrier. At this stage the cycling operation has not yet begun.

Figure 23:
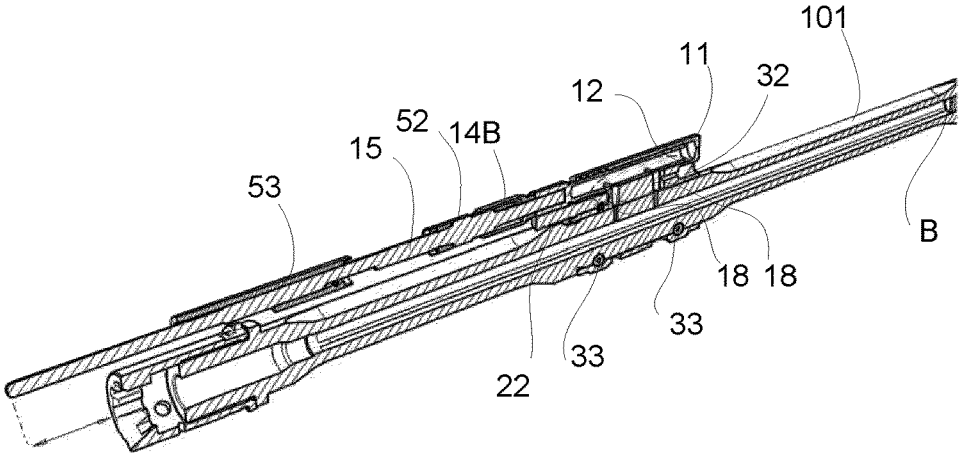

In FIG. 23 is shown stage 2, when the bullet B has reached the end of the barrel 101. The gas piston 12 has moved to rest against the force transmitter assembly 13 (FIGS. 2-7, 11-15) and the force transmitter 15 (FIGS. 2-7, 11-12, 17), which are still stationary and have not yet accelerated the bolt carrier. At this stage no more gas from barrel 101 can flow into the gas openings 18 and the exhaust opening 32 is still closed. Additionally, to the bushing 14B or the spring-loaded pin 14 (FIGS. 4-6) pressure inside the gas block 11 acts onto the bolt carrier by means of the force transmitter assembly 13 (FIGS. 2-7, 11-15) and the force transmitter 15 (FIGS. 2-7, 11-12, 17). After the bullet B has passed through the end of the barrel 101, movement of the bolt carrier is initiated. As this happens only after the bullet B has left the barrel 101, any harmful vibrations cannot influence accuracy of the trajectory of the bullet B anymore. After this stage, the movement of the bolt carrier will unlock the bolt and finally start the cycling operation, which has altogether been delayed up till this stage. It should be noted that in the gas operating systems according to prior art the cycling starts immediately once gas reaches the gas piston.

Figure 24:
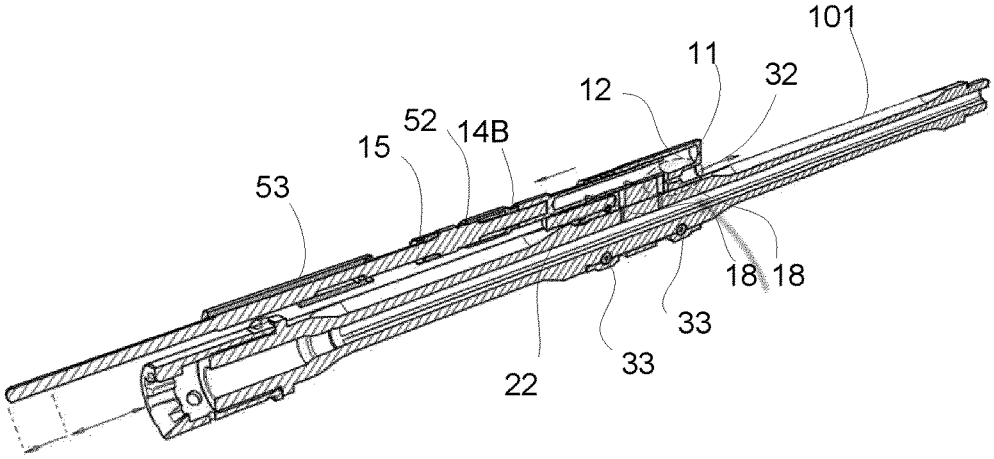

In FIG. 24 are shown stages 3 and 4, when the bullet B is long gone and travels towards its target along its trajectory. In the meantime the pressurized gas enclosed within the internal volume of the gas openings 18 has carried out work and by means of the gas piston 12 pushed the force transmitter assembly 13 (FIGS. 2-7, 11-15) and the force transmitter 15 (FIGS. 2-7, 11-12, 17) backwards for a certain distance and therewith transmitted momentum to the bolt carrier. The force transmitter assembly 13 (FIGS. 2-7, 11-15), the force transmitter 15 (FIGS. 2-7, 11-12, 17) and the gas piston 12 stop at some point and the bolt carrier and the bolt continues moving on its own in accordance to "the short-stroke system"—principle. Shortly before the gas piston 12 reaches its rest position after having accelerated the bolt and the bolt carrier, the exhaust opening 32 is opened. At this point the still pressurized working gas inside the gas block 11 is streaming through the exhaust opening 32 forward away from the shooter and the gas is released to the environment. The openings of the gas piston 12 are still shut so that no remaining combustion gases can flow into the gas block 11 through the gas openings 18. After the pressure inside the gas block 11 has sunk sufficiently, the spring-actuated force transmitter assembly 13 including the force transmitter 15 and the spring-loaded bushing 14, 14B will together with the gas piston 12 return into their initial position i.e. stage 1 shown in FIG. 22.

It should be noted that in the above description referring to the FIGS. 22-24 the operation of the gas system 10 has been explained in view of an example comprising two gas openings 18. The gas system 10 can comprise one or more gas openings 18.

In FIGS. 25-35 is shown one advantageous embodiment of the gas system according to the invention.

Figure 25:
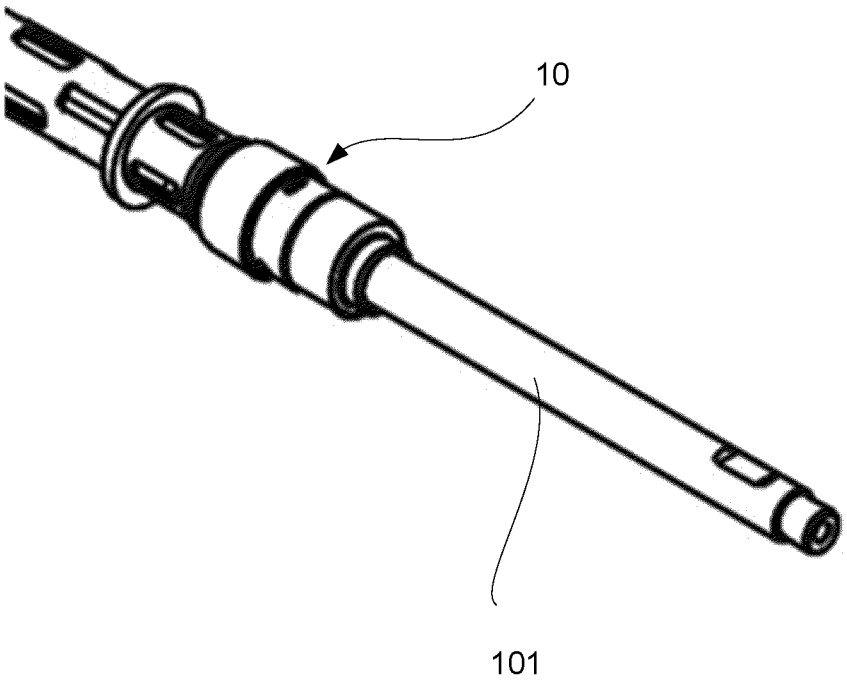
In FIGS. 25-32 is schematically shown another advantageous example of a gas system according to the invention, in which the gas system is arranged around the barrel of the firearm.

In the example of FIG. 25 is shown another example of a gas system 10 of the firearm 100. The gas system 10 is located around the barrel 101 of the firearm 100.

Figure 26:
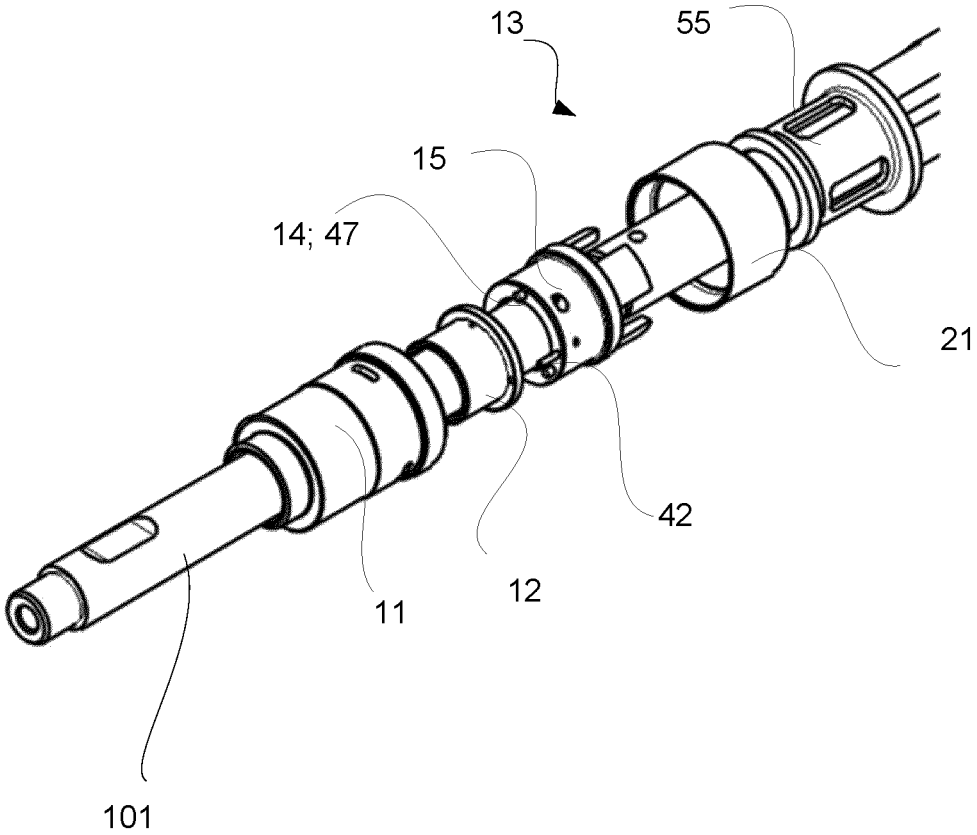

In FIG. 26 is shown as an exploded view the example of FIG. 25 of the gas system 10 located around the barrel 101 of the firearm 100. The gas system 10 comprises a gas block 11, a gas piston 12 by which the energy of the gas is transmitted to mechanical movement inside the gas block 11, an indexing part 21 and a force transmitter assembly 13. A force transmitter assembly comprises a sleeve 15, an extension part 55 with spring (not shown), spring-loaded pins 14 with springs 47 and guide pin 42 for keeping the gas openings in gas piston 12 and barrel 101 aligned.

Figure 27:
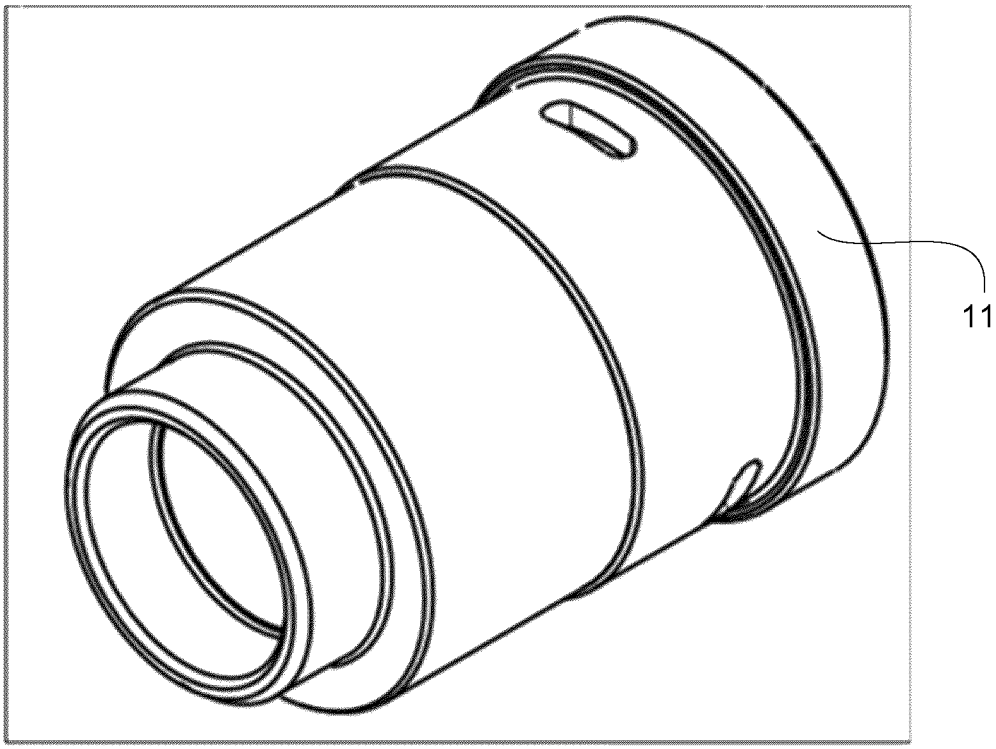

In FIG. 27 is shown the gas block 11 of the example of FIGS. 25-26.

Figure 28:
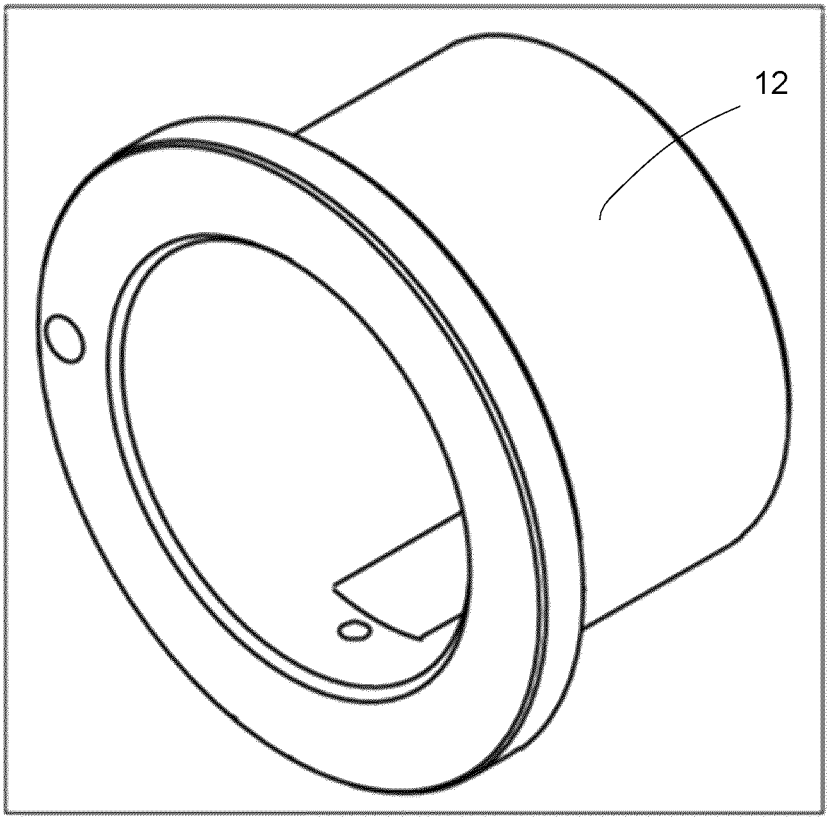

In FIG. 28 is shown the gas piston 12 of the example of FIGS. 26, 33-35.

Figure 29:
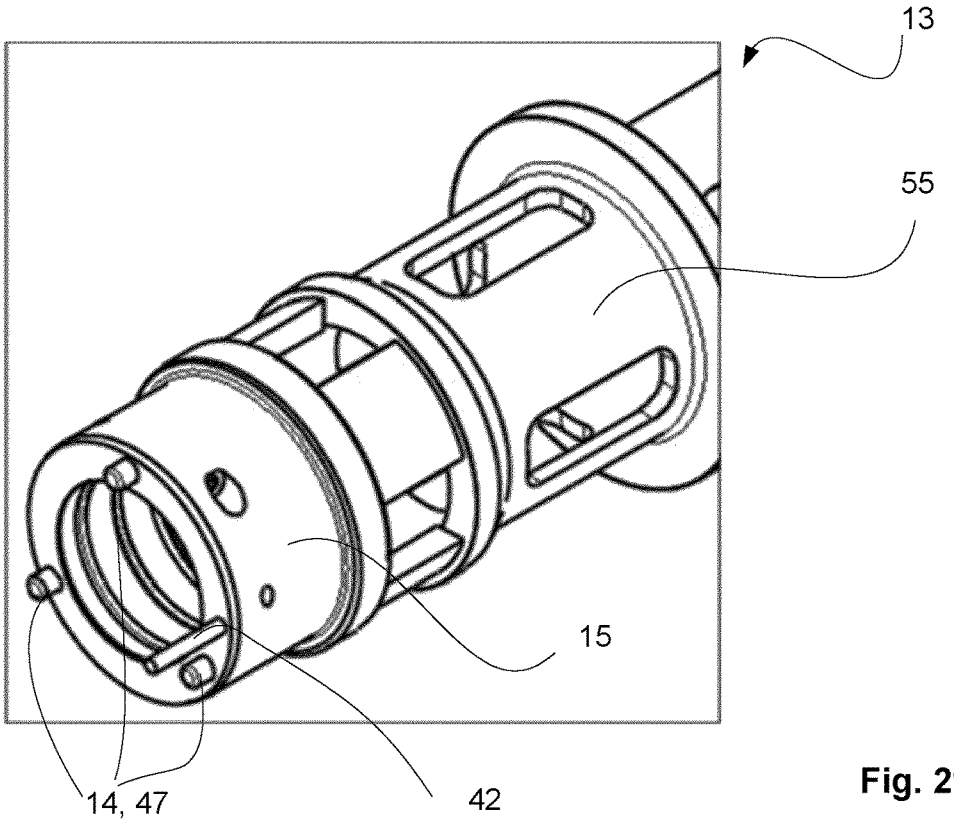

In FIG. 29 is shown the force transmitter assembly 13 of the example of the FIGS. 26, 33-35. A force transmitter assembly comprises a sleeve 15, an extension part 55 with a spring (not shown), spring-loaded pins 14 with springs 47 and a guide pin 42.

Figure 30:
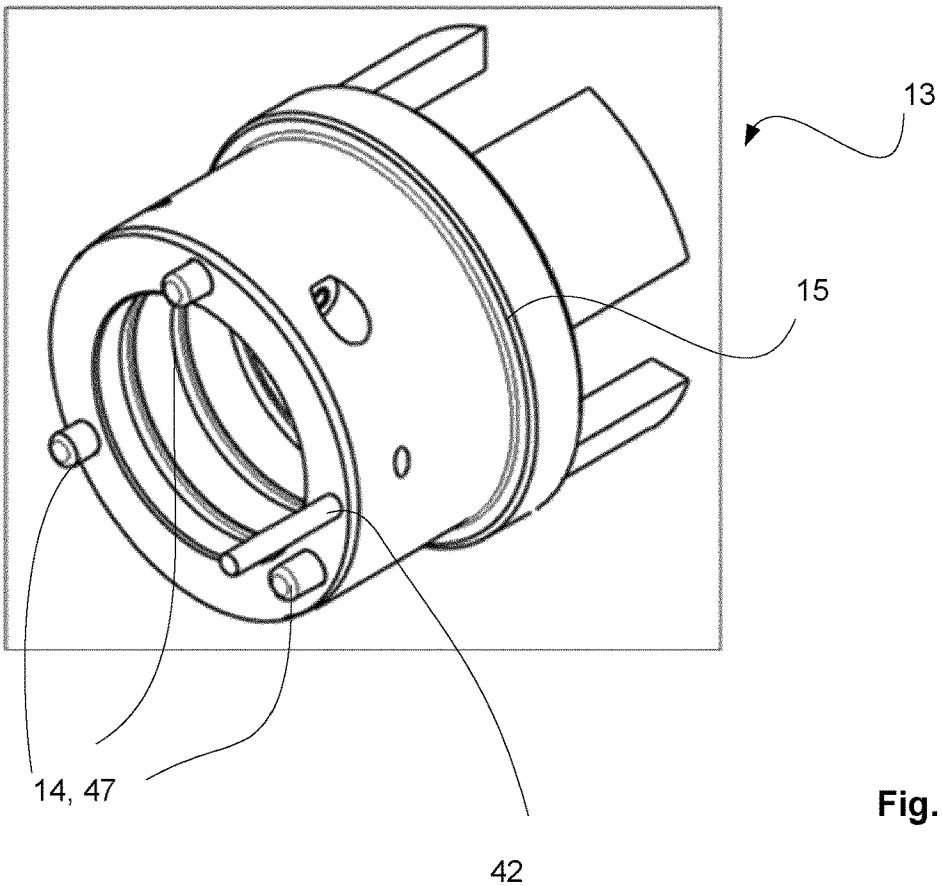

In FIG. 30 is shown the force transmitter assembly 13 of the example of the FIG. 26 in greater detail. The force transmitter sleeve 15 comprises three pins 14, which are spring-loaded with springs 47 and one guide pin 42.

Figure 31:
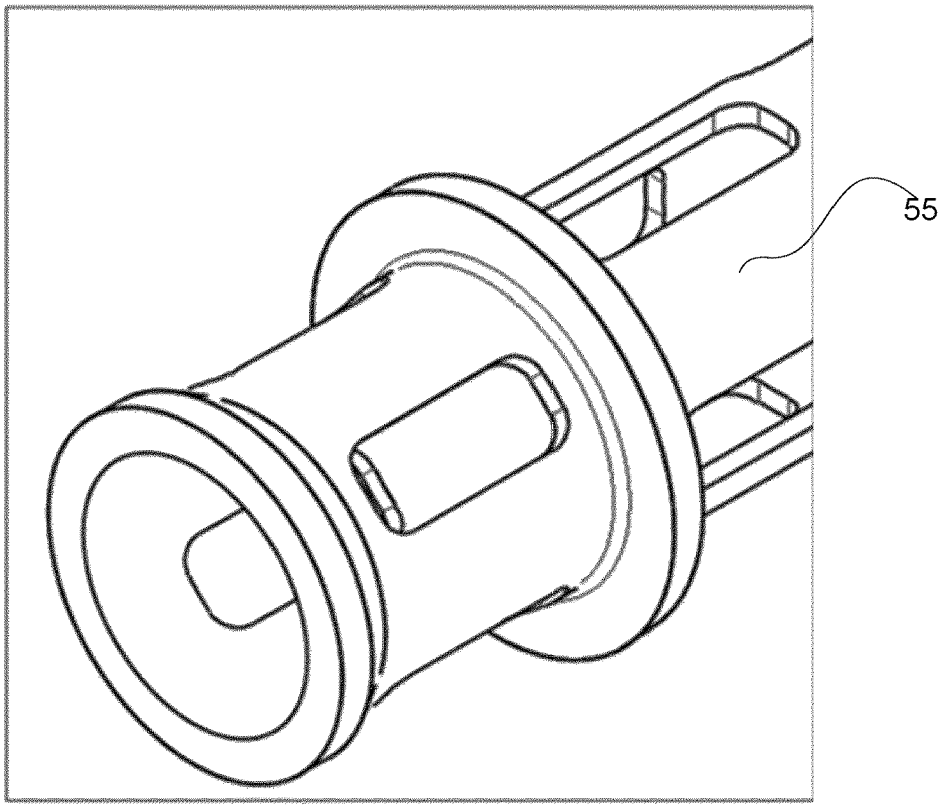
Figure 32:
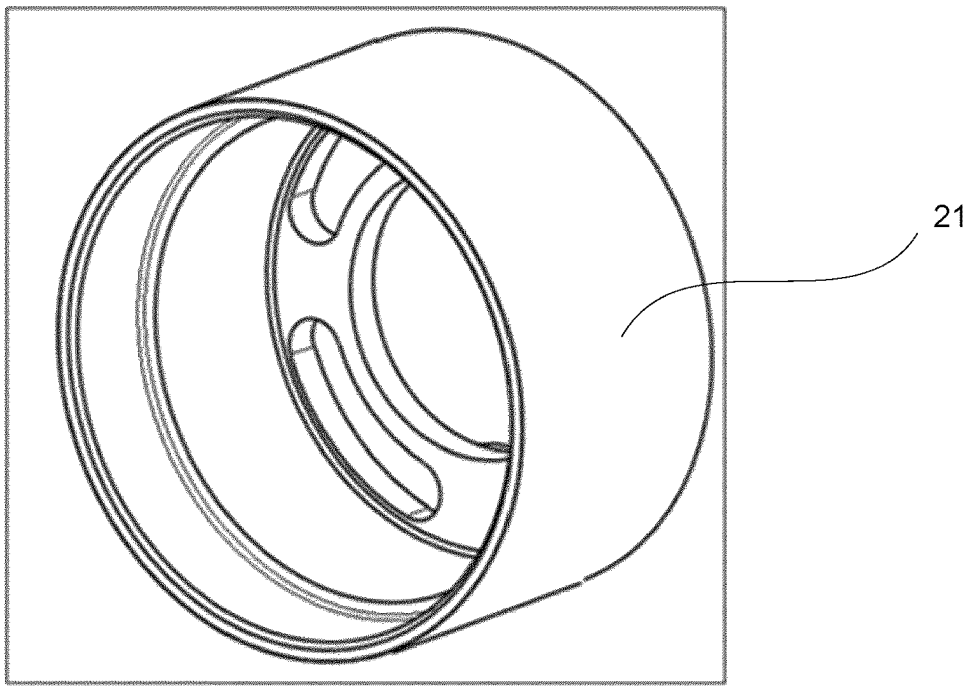

In FIGS. 31-32 is shown the force transmitter extension part 55 and the indexing part 21 of the example of the FIGS. 25-26.

Figure 33:
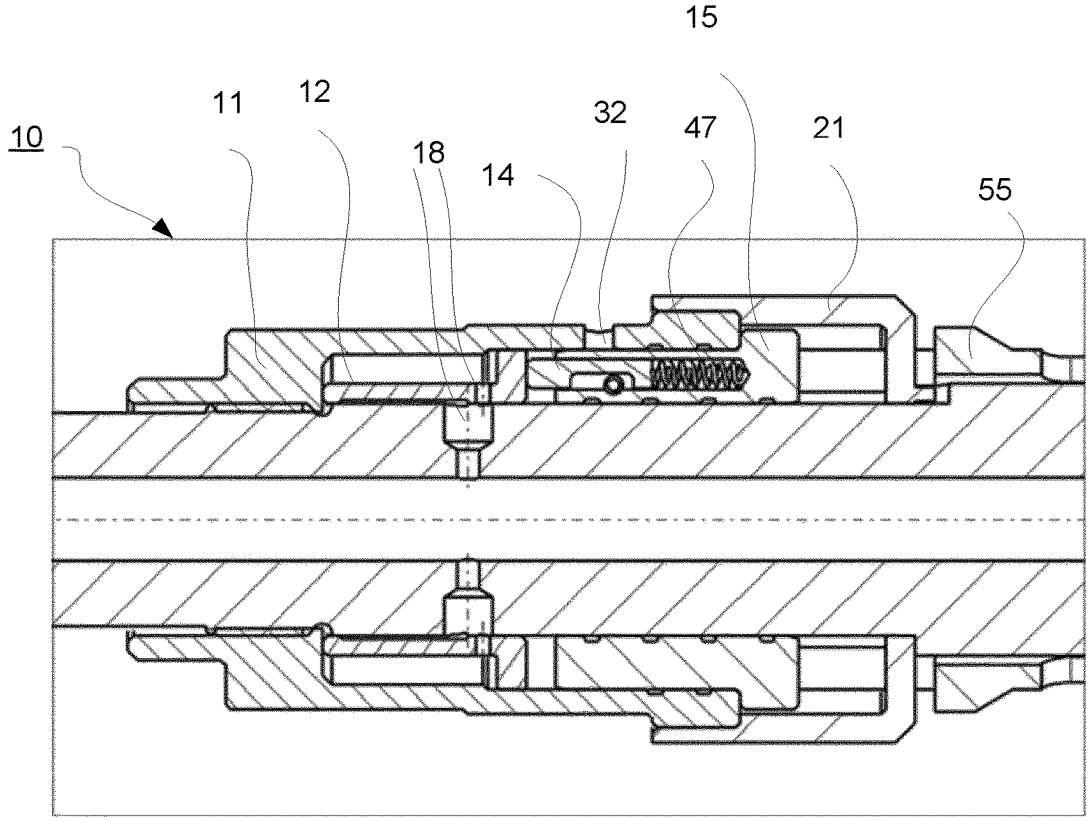
In FIGS. 33-35 is schematically shown advantageous examples of operation of the gas system according to the invention.
Figure 34:
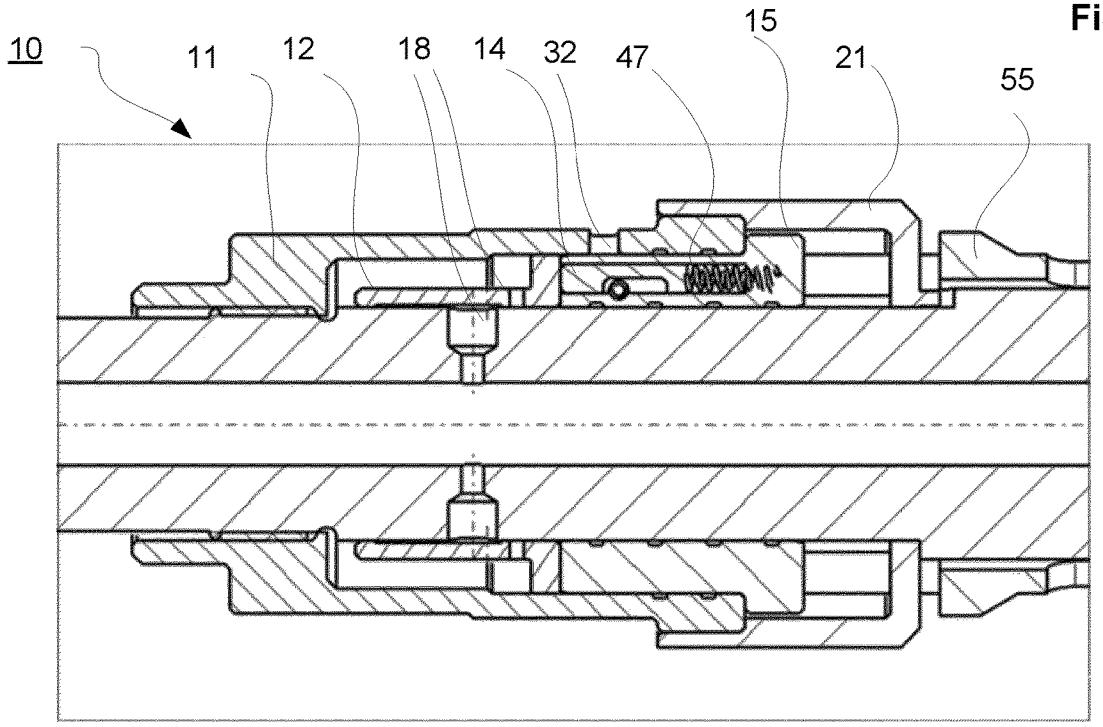
Figure 35:
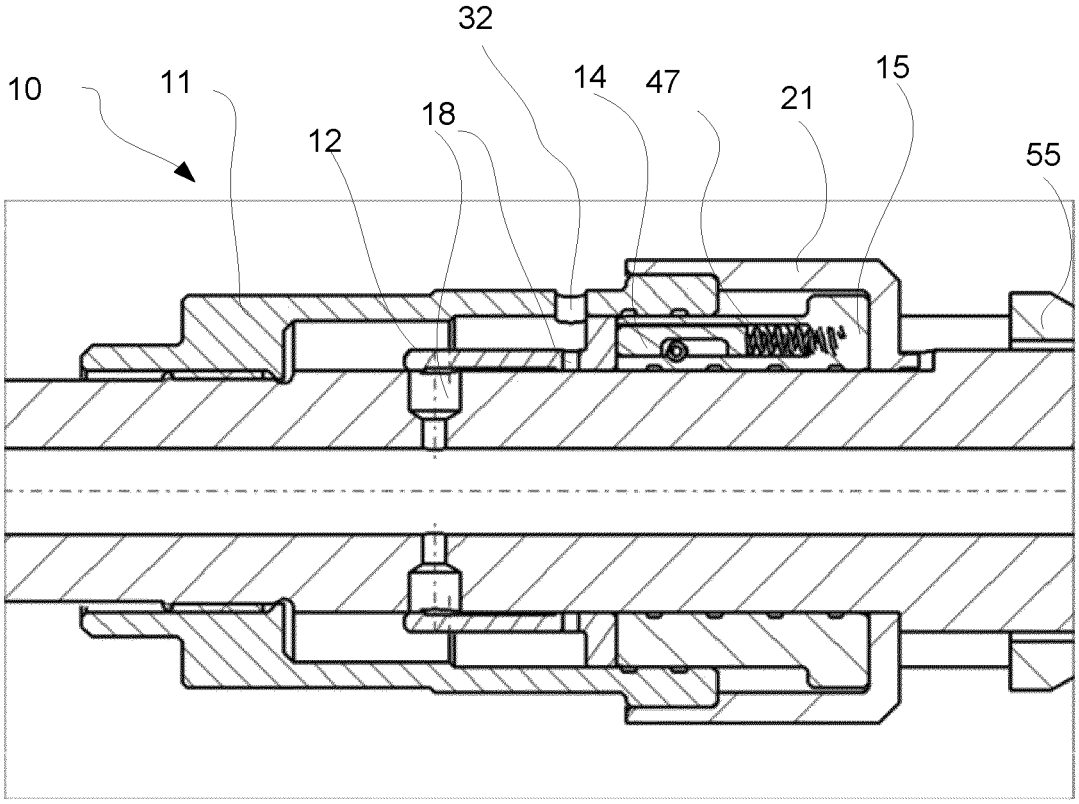

In the following the operation of the gas system 10 is described with reference to FIGS. 33-35 and to the example of the FIGS. 25-32 but it should be noted that the examples presented in FIGS. 2-24 operate correspondingly by substantially same functions and basis. In FIG. 33 is shown the basic situation and in FIG. 34 the situation, when the gas piston 12 and spring-loaded pins 14 move and in FIG. 35 the situation, when the gas piston 12 and the force transmitter assembly 13 move.

The gas block 11 and the indexing part 21 are not moving parts but instead stay at their locations. In the basic situation the force transmitter assembly 13 has pushed the gas piston 12 to its front position and thus, the spring-loaded pins 14 have pushed the gas piston 12 to its front position and the gas can flow through the gas openings 18 to the space in between the gas piston 12 and the gas block 11. Pressure of the gas in the space between the gas piston 12 and the gas block 11 moves the gas piston 12 and from the gas opening 18 no further gas can enter the space between the gas piston 12 and the gas block 11. The spring-loaded pins 14 of the force transmitter sleeve 15 have been pressed in to pressed position. When the pressure of the gas between the gas piston 12 and the gas block 11 has moved the force transmitter assembly 13 against the indexing part 21 the gas can flow off through the openings 32 in the gas block 11. At the end, the force transmitter assembly 13 and the gas piston 12 are pushed to the front position and the spring-loaded pins 14 push the gas sleeve to its front position and the gas system 10 is back in the basic situation.

In the description in the foregoing, although some functions and elements have been described with reference to certain features and examples, those functions and elements may be performable by other features and examples whether described or not. Although features have been described with reference to certain embodiments or examples, those features may also be present in other embodiments or examples whether described or not.

Above only some advantageous examples of the inventions have been described to which examples the invention is not to be narrowly limited and many modifications and alterations are possible within the invention.

The invention claimed is:

1. A firearm comprising a barrel comprising a gas opening, and a gas system, in which the gas system comprises a gas block, a gas piston, a force transmitter assembly comprising at least one force transmitter, an indexing part, gas openings, in which the gas block is fixedly attached to the barrel, in which the gas piston is positioned by the indexing part, in which the gas system gas is configured to pass through the gas opening of the barrel via the gas openings of the gas system into the gas block and to set the gas piston to movement, wherein the gas piston is connected via a spring-loaded pin or bushing to at least one force transmitter of the force transmitter assembly, such that in the gas system the gas piston during its movement backwards is configured to close the gas opening of the barrel for a defined time period and that the gas piston is not transmitting power/energy from combustion gas to the force transmitter assembly unless the gas openings of the gas system are closed.

2. The fire arm according to claim 1, wherein the gas system is a short stroke gas piston system.

3. The firearm according to claim 1, wherein the gas block is attached onto the barrel of the firearm.

4. The firearm according to claim 1, wherein the gas block is attached around the barrel of the firearm.

5. The firearm according to claim 4, wherein the gas system is located around the barrel of the firearm and comprises the gas block (11), the gas piston by which the energy of the gas is transmitted to mechanical movement inside the gas block, the indexing part and the force transmitter assembly and that the force transmitter assembly comprises a force transmitter sleeve, an extension part with a spring, spring-loaded pins with springs and a guide pin for keeping the gas openings in gas piston and barrel aligned.

6. The firearm according to claim 1, wherein the gas system comprises an exhaust opening in the gas block and that after a certain period of time the exhaust opening connected to ambient pressure is opened.

7. The firearm according to claim 1, wherein the gas block and the gas piston together form a hollow encapsulation which is filled with gas from barrel.

8. The firearm according to claim 1, wherein the force transmitter assembly comprises a helical, return spring, which is configured to function as a return-spring returning the force transmitter assembly.

9. The firearm according to claim 1, wherein the indexing part comprises beveled surfaces and an indexing groove to keep the gas openings of the gas piston aligned with gas openings in the barrel and the gas block.

10. The firearm according to claim 1, wherein the indexing part has an indexing counterpart with an indexing protrusion, which corresponds to the indexing groove of the indexing part of the gas piston.

11. The firearm according to claim 1, wherein outer surface of the gas piston is provided with grooves for crust removal.

* * * * *